US006049999A

United States Patent [19]

Skaugen et al.

[11] Patent Number: 6,049,999

[45] **Date of Patent: *Apr. 18, 2000**

[54] MACHINE AND PROCESS FOR THE RESTRAINED DRYING OF A PAPER WEB

[75] Inventors: Borgeir Skaugen; Gregory L. Wedel, both of Beloit, Wis.

[73] Assignee: Beloit Technologies, Inc., Wilmington, Del.

[ * ] Notice: This patent is subject to a terminal disclaimer.

[21] Appl. No.: 08/871,573

[22] Filed: Jun. 9, 1997

Related U.S. Application Data

[63] Continuation-in-part of application No. 08/631,576, Apr. 12, 1996, Pat. No. 5,636,448, which is a continuation of application No. 08/100,735, Aug. 2, 1993, Pat. No. 5,507,104, which is a continuation-in-part of application No. 07/530,386, May 30, 1990, Pat. No. 5,279,049, which is a continuation of application No. 07/201,705, Jun. 2, 1988, abandoned, which is a continuation of application No. 07/167,672, Feb. 11, 1988, abandoned, which is a continuation-in-part of application No. 07/014,569, Feb. 13, 1987, Pat. No. 4,934,067.

[51] Int. Cl.[7] ..... D21F 5/00

[52] U.S. Cl. ..... 34/453; 34/117

[58] Field of Search ..... 34/447, 453, 458, 34/117; 162/193, 363, 368

[56] References Cited

U.S. PATENT DOCUMENTS

| | | | |
|---|---|---|---|
| D. 320,105 | 9/1991 | Skaugen et al. | D34/28 |
| D. 321,269 | 10/1991 | Skaugen et al. | D32/1 |
| D. 333,710 | 3/1993 | Skaugen et al. | D32/1 |
| 409,615 | 8/1889 | Palmer . | |
| 1,402,451 | 1/1922 | Shellington . | |
| 1,656,853 | 1/1928 | Bean . | |
| 2,224,803 | 12/1940 | Standley | 34/48 |
| 2,281,340 | 4/1942 | Thiele et al. | 91/55 |
| 2,537,129 | 1/1951 | Goodwillie | 92/49 |
| 2,714,342 | 8/1955 | Beachler | 92/53 |
| 2,755,711 | 7/1956 | Moore | 92/74 |
| 2,959,222 | 11/1960 | Hornbostel | 162/360 |
| 3,079,699 | 3/1963 | Fry, Jr. | 34/13 |
| 3,110,612 | 11/1963 | Gottwald et al. | 117/64 |

(List continued on next page.)

FOREIGN PATENT DOCUMENTS

| | | |
|---|---|---|
| 0 254 666 | 1/1988 | European Pat. Off. . |
| 0 254 665 B1 | 5/1991 | European Pat. Off. . |
| 2 355 397 | 6/1974 | Germany . |
| 35 20 070 | 12/1985 | Germany . |

(List continued on next page.)

OTHER PUBLICATIONS

U.S. application No. 07/167,672, Skaugen et al., filed Feb. 11, 1988.

U.S. application No. 07/201,705, Skaugen et al., filed Jun. 2, 1988.

(List continued on next page.)

*Primary Examiner*—Henry Bennett
*Assistant Examiner*—Steve Gravini
*Attorney, Agent, or Firm*—McAndrews, Held & Malloy, Ltd.

[57] ABSTRACT

A papermaking machine including a forming section for forming a paper web, a press section for pressing water from the paper web, and a dryer for drying the paper web is disclosed. The dryer includes a wet end for drying the paper web to at least about 60 percent solids and a dry end for further drying the paper web. The dry end includes at least one series of alternating dryer cylinders and vacuum rolls. A dryer felt transports the paper web as the dryer felt travels about each dryer cylinder and each vacuum roll of the series. In one disclosed embodiment, at least one of the vacuum rolls receives a vacuum of at least about one inch water column (1.5 kilo-pascals, "kPa") to restrain the web as it dries. A method for manufacturing a paper web while restraining it by using the dryer apparatus described above is also disclosed. Drying the paper web under restraint in the dry end of the dryer can substantially reduce cross-machine direction shrinkage and stretch of the web, reduce edge curl, and have other substantial benefits.

49 Claims, 8 Drawing Sheets

U.S. PATENT DOCUMENTS

| | | | |
|---|---|---|---|
| 3,250,019 | 5/1966 | Beachler | 34/117 |
| 3,263,344 | 8/1966 | Stickle | 34/116 |
| 3,314,162 | 4/1967 | Haywood | 34/111 |
| 3,395,073 | 7/1968 | Davis, Sr. | 162/369 |
| 3,445,938 | 5/1969 | Clark | 34/116 |
| 3,503,139 | 3/1970 | Mahoney | 34/111 |
| 3,723,169 | 3/1973 | Guastella et al. | 117/111 |
| 3,808,090 | 4/1974 | Logan et al. | 162/23 |
| 3,816,941 | 6/1974 | Holik et al. | 34/116 |
| 3,861,997 | 1/1975 | Ely | 162/360 |
| 3,868,780 | 3/1975 | Soininen et al. | 34/116 |
| 3,874,997 | 4/1975 | Kankaanpää | 162/290 |
| 3,891,501 | 6/1975 | Oka et al. | 162/290 |
| 3,948,449 | 4/1976 | Logan et al. | 241/41 |
| 3,981,084 | 9/1976 | Sobota | 34/123 |
| 4,000,035 | 12/1976 | Schiel et al. | 162/290 |
| 4,075,056 | 2/1978 | Ely et al. | 162/305 |
| 4,086,131 | 4/1978 | Rempel et al. | 162/203 |
| 4,115,189 | 9/1978 | Cyrenne | 162/305 |
| 4,179,330 | 12/1979 | Page | 162/113 |
| 4,183,148 | 1/1980 | Koski et al. | 34/23 |
| 4,202,113 | 5/1980 | Kankaanpää | 34/23 |
| 4,236,962 | 12/1980 | Kankaanpää | 162/204 |
| 4,257,844 | 3/1981 | Schmitt et al. | 162/305 |
| 4,335,603 | 6/1982 | Locke | 73/159 |
| 4,359,827 | 11/1982 | Thomas | 34/16 |
| 4,359,828 | 11/1982 | Thomas | 34/114 |
| 4,361,466 | 11/1982 | Wong et al. | 162/207 |
| 4,406,739 | 9/1983 | Kankaanpää | 162/203 |
| 4,441,263 | 4/1984 | Vedenpää | 34/115 |
| 4,444,361 | 4/1984 | Nuttall | 242/65 |
| 4,481,723 | 11/1984 | Vedenpää | 34/114 |
| 4,483,083 | 11/1984 | Chance | 34/113 |
| 4,502,231 | 3/1985 | Fissmann et al. | 34/114 |
| 4,510,698 | 4/1985 | Ely | 34/117 |
| 4,517,054 | 5/1985 | Hujala et al. | 162/301 |
| 4,523,978 | 6/1985 | Pullinen | 162/300 |
| 4,526,655 | 7/1985 | Karvinen et al. | 162/360.1 |
| 4,539,762 | 9/1985 | Eskelinen et al. | 34/114 |
| 4,543,160 | 9/1985 | Kerttula et al. | 162/193 |
| 4,551,203 | 11/1985 | Eskelinen | 162/202 |
| 4,556,451 | 12/1985 | Ely | 162/205 |
| 4,566,944 | 1/1986 | Mauranen et al. | 162/286 |
| 4,566,946 | 1/1986 | Koponen et al. | 162/359 |
| 4,584,058 | 4/1986 | Lehtinen et al. | 162/199 |
| 4,602,439 | 7/1986 | Eskelinen et al. | 34/23 |
| 4,608,124 | 8/1986 | Mauranen et al. | 162/193 |
| 4,609,435 | 9/1986 | Tissari | 162/203 |
| 4,614,566 | 9/1986 | Koponen et al. | 162/301 |
| 4,625,430 | 12/1986 | Aula et al. | 34/13 |
| 4,625,434 | 12/1986 | Karlsson et al. | 34/114 |
| 4,654,981 | 4/1987 | Grebe et al. | 34/114 |
| 4,669,198 | 6/1987 | Wedel | 34/23 |
| 4,677,762 | 7/1987 | Futcher | 34/114 |
| 4,684,443 | 8/1987 | Kerttula et al. | 162/255 |
| 4,686,778 | 8/1987 | Kotitschke et al. | 34/117 |
| 4,693,784 | 9/1987 | Aula et al. | 162/202 |
| 4,716,660 | 1/1988 | Thiele | 34/114 |
| 4,728,396 | 3/1988 | Alheid | 162/193 |
| 4,738,035 | 4/1988 | Grebe et al. | 34/114 |
| 4,744,156 | 5/1988 | Futcher | 34/114 |
| 4,744,866 | 5/1988 | Koponen et al. | 162/203 |
| 4,758,310 | 7/1988 | Miller | 162/359 |
| 4,768,294 | 9/1988 | Weideburg | 34/116 |
| 4,792,381 | 12/1988 | Pajula | 162/360.1 |
| 4,793,899 | 12/1988 | Skaugen | 162/381 |
| 4,807,371 | 2/1989 | Wedel | 34/117 |
| 4,815,220 | 3/1989 | Wedel | 34/120 |
| 4,835,881 | 6/1989 | Welsby | 34/117 |
| 4,844,442 | 7/1989 | Gämmerler | 271/225 |
| 4,850,121 | 7/1989 | Ely | 34/116 |
| 4,874,470 | 10/1989 | Skaugen | 162/360.1 |
| 4,875,976 | 10/1989 | Wedel | 162/306 |
| 4,876,803 | 10/1989 | Wedel | 34/117 |
| 4,882,854 | 11/1989 | Wedel et al. | 34/115 |
| 4,888,883 | 12/1989 | Kerttula | 34/116 |
| 4,889,598 | 12/1989 | Niskanen | 162/199 |
| 4,905,379 | 3/1990 | Wedel | 34/16 |
| 4,909,905 | 3/1990 | Ilmarinen et al. | 162/360.1 |
| 4,917,766 | 4/1990 | Koivuranta et al. | 162/301 |
| 4,918,836 | 4/1990 | Wedel | 34/23 |
| 4,919,760 | 4/1990 | Kerttula | 162/300 |
| 4,919,762 | 4/1990 | Laapotti et al. | 162/360.1 |
| 4,923,568 | 5/1990 | Hietikko et al. | 162/301 |
| 4,931,143 | 6/1990 | Karvinen et al. | 162/360.1 |
| 4,934,067 | 6/1990 | Wedel | 34/41 |
| 4,943,351 | 7/1990 | Wedel | 162/205 |
| 4,945,655 | 8/1990 | Wedel | 34/23 |
| 4,967,489 | 11/1990 | Autio | 34/114 |
| 4,970,805 | 11/1990 | Wedel | 34/115 |
| 4,972,608 | 11/1990 | Ilvespää | 34/115 |
| 4,976,821 | 12/1990 | Laapotti | 162/360.1 |
| 4,980,979 | 1/1991 | Wedel | 34/23 |
| 4,982,513 | 1/1991 | Loser et al. | 34/116 |
| 4,986,009 | 1/1991 | Haessner et al. | 34/23 |
| 5,020,242 | 6/1991 | Mayer et al. | 34/115 |
| 5,031,338 | 7/1991 | Wedel | 34/115 |
| 5,033,207 | 7/1991 | Sturm et al. | 34/115 |
| 5,037,509 | 8/1991 | Wedel | 162/286 |
| 5,044,095 | 9/1991 | Eivola | 34/117 |
| 5,046,266 | 9/1991 | Autio | 34/120 |
| 5,050,317 | 9/1991 | Kade et al. | 34/117 |
| 5,062,216 | 11/1991 | Hannigan | 34/16 |
| 5,063,689 | 11/1991 | Sollinger | 34/115 |
| 5,064,503 | 11/1991 | Tavi | 162/359 |
| 5,065,529 | 11/1991 | Skaugen et al. | 34/117 |
| 5,068,980 | 12/1991 | Müller | 34/117 |
| 5,074,966 | 12/1991 | Koivuranta | 162/301 |
| 5,084,139 | 1/1992 | Autio | 162/360.1 |
| 5,087,325 | 2/1992 | Page | 162/193 |
| 5,101,577 | 4/1992 | Wedel | 34/114 |
| 5,105,561 | 4/1992 | Wulz | 34/117 |
| 5,115,581 | 5/1992 | Viitanen | 34/115 |
| 5,144,758 | 9/1992 | Skaugen et al. | 34/117 |
| 5,146,696 | 9/1992 | Mayer et al. | 34/117 |
| 5,151,156 | 9/1992 | Schiel | 162/368 |
| 5,152,078 | 10/1992 | Wedel | 34/115 |
| 5,169,501 | 12/1992 | Meinecke | 162/359.1 |
| 5,175,945 | 1/1993 | Skaugen et al. | 34/117 |
| 5,177,880 | 1/1993 | Preisetanz et al. | 34/117 |
| 5,184,408 | 2/1993 | Kotitschke et al. | 34/117 |
| 5,185,063 | 2/1993 | Aula et al. | 162/193 |
| 5,249,372 | 10/1993 | Wedel | 34/117 |
| 5,279,049 | 1/1994 | Skaugen et al. | 34/115 |
| 5,507,104 | 4/1996 | Skaugen et al. | 34/117 |
| 5,535,527 | 7/1996 | Virta et al. | 34/117 |
| 5,636,448 | 6/1997 | Skaugen et al. | 34/117 |

FOREIGN PATENT DOCUMENTS

| | | |
|---|---|---|
| 90 01 209 U | 5/1990 | Germany . |
| 61-217673 | 9/1986 | Japan . |
| 63-105197 | 5/1988 | Japan . |
| 305229 | 6/1971 | U.S.S.R. . |
| 1121341 | 10/1984 | U.S.S.R. . |
| 733242 | 7/1955 | United Kingdom . |
| 775206 | 5/1957 | United Kingdom . |
| 919932 | 2/1963 | United Kingdom . |
| 2 173 832 | 10/1986 | United Kingdom . |
| WO 81/01428 | 5/1981 | WIPO . |
| WO 82/02937 | 9/1982 | WIPO . |
| WO 83/00514 | 2/1983 | WIPO . |
| WO 88/04206 | 6/1988 | WIPO . |

| | | |
|---|---|---|
| WO 88/06201 | 8/1988 | WIPO . |
| WO 88/06205 | 8/1988 | WIPO . |
| WO 88/08898 | 11/1988 | WIPO . |
| WO 90/04065 | 4/1990 | WIPO . |

OTHER PUBLICATIONS

U.S. application No. 07/606,654, Skaugen et al., filed Oct. 31, 1990.
U.S. application No. 07/797,597, Skaugen et al., filed Sep. 25, 1991.
U.S. application No. 08/064,840, Skaugen et al., filed Mar. 2, 1992.
*Tappi Journal*, Sep. 1987, pp. 65–69, "Advances in Dryer Section Runnability" by G.L. Wedel and S. Palazzolo.
*Paper*, Jul. 1987, pp. 27–28, "Examining Runnability in the Dryer Section" by I. Binns.
*Consolidated News*, Aug.–Oct. 1991, vol. 29, No. 4, pp. 8–9, "No. 16 takes shape".
Sheet Flutter & Windage, Tappi Press, 1991.
*Die Paper Fabrikation und ihre Maschinen*, (1938), published in Germany, vol. II, pp. 155–157, Drawing Sheet No. 503, Drawing Sheet No. 23, and Drawing entitled Paper Machine V—2100 trimmed paper width for Mr. T.W. Branders—Berg–Gladbach—1900 (with English translation).
J. Linderot, "Zehn Jahre Erfahrung mit Geschlossener Bahnfuhrun in der Trockenpartie," *Wochenblatt Fur Papierfabrikation*, Aug., 1986, vol. 14, No. 16, pp. 623–629 (with translation).

"Pulp and Paper Dictionary" by John R. Lavigne, 1986.

International Search Report, International Application No. PCT/EP90/00505, International Search Report date of mailing Jul. 6, 1990.

International Search Report, International Application No. EP96 10 8669, International Search Report Date of Mailing Jul. 7, 1997.

International Search Report, International Application No. EP96 10 3091, International Search Report Date of Mailing Sep. 16, 1997.

International Search Report, International Application No. EP96 10 8351, International Search Report Date of Mailing Jul. 28, 1997.

EFFECT OF SHEET VACUUM RESTRAINT ON SHEET SHRINKAGE

EFFECT OF SHEET VACUUM RESTRAINT ON SAMPLE TENSILE STRENGTH

VACUUM RESTRAINT. IN. W. C.
EFFECT OF SHEET VACUUM RESTRAINT ON SAMPLE TEA

SINGLE-FELT DRYER SECTION

BELOIT BELRUN SINGLE-TIER DRYER SECTION

SAMPLE SHRINKAGE CHARACTERISTICS

EFFECT OF REFINING

EFFECT OF RESTRAINT ON HYGROEXPANSIVITY (2)

MACHINE AND PROCESS FOR THE RESTRAINED DRYING OF A PAPER WEB

CROSS-REFERENCE TO RELATED APPLICATIONS

This is a continuation in part of Ser. No. 08/631,576, filed Apr. 12, 1996, now U.S. Pat. No. 5,636,448, which is a continuation of Ser. No. 08/100,735, filed Aug. 2, 1993, now U.S. Pat. No. 5,507,104, which is a continuation-in-part of Ser. No. 07/530,386, filed May 30, 1990, now U.S. Pat. No. 5,279,049, which is a continuation of Ser. No. 07/201,705 filed on Jun. 2, 1988, now abandoned, which is a continuation in part of U.S. Ser. No. 014,569 filed Feb. 13, 1987, now U.S. Pat. No. 4,934,067.

Ser. No. 08/100,735 is also a continuation in part of U.S. Ser. No. 867,722, filed Apr. 9, 1992, now U.S. Pat. No. 5,249,372, which is a continuation of U.S. Ser. No. 07/167, 672, filed Feb. 11, 1988, now abandoned, which is a continuation-in-part of U.S. Ser. No. 014,569, filed Feb. 13, 1987, now U.S. Pat. No. 4,934,067. All the disclosure of each application identified above is incorporated herein by reference.

BACKGROUND OF THE INVENTION

The present invention relates to a machine and process for the restrained drying of a paper web in a dryer of a paper making machine. More particularly, vacuum is supplied in the vacuum rolls located in the dry end of the dryer for restraining the web against the felt or fabric.

Paper is made by forming a web (a web is a continuously formed sheet of material) in a forming section from a slurry or "furnish" which is roughly 99% water and 1% paper pulp. As the web is formed, most of the water is separated from the web by sieving it on a conveyor belt made of wire screen, leaving a loose mat of paper fibers. The web is then pressed in a press section to remove some more of the water. The web is then guided through a dryer where it is brought into contact with a large number of rotating, steam-heated metal rollers to evaporate the remaining water from the web. How the web is formed and dried has an important bearing on the characteristics of the resulting dry paper.

The classic paper dryer consists entirely of two or more double-felted two tier dryer groups. A double tier dryer group is shown in FIG. 1. In each double-felted, double-tier dryer group there are two horizontal rows or "tiers" of dryer cylinders, one tier (dryer cylinders 11 and 12) above the other tier (dryer cylinders 14 and 15). The web is held against one dryer cylinder (14) of the lower tier, then is transferred to a dryer cylinder (11) of the upper tier, then progresses to the next dryer cylinder (15) of the lower tier, then goes to the next dryer cylinder (12) of the upper tier, and so forth.

The thermal contact between the paper and each dryer cylinder is maintained by tensioned dryer felts which apply a pressure to the paper as it wraps the dryer cylinder. Typical felt tensions range from 8 to 15 pounds per linear inch (PLI) which depending on the dryer cylinder diameter, will apply a felt pressure which is in the range of 0.22 to 0.50 PSI which is 6 to 14 inches water gauge (WG) or water column (WC) (1.5–2.5 kPa). The felt tension may be provided by a conventional felt tensioner, typically a movable roll loaded against the felt. The felt pressure not only improves the drying contact, but also applies restraint to the paper to prevent shrinkage from occurring.

This type of dryer group is called a "double-felted" group because it has two felts which alternately engage the web.

The upper felt wraps around the upper part of each dryer cylinder in the upper tier, and the lower felt wraps around the lower part of each dryer cylinder in the lower tier. When the web is between the top felt and a top dryer cylinder, the bottom of the web is against the dryer cylinder. When the web is between the bottom felt and a bottom dryer cylinder, the top side of the web is against the dryer cylinder. The web is thus alternately heated on its top and bottom sides as it passes over dryer cylinders of the lower and upper tiers. In a double-felted two tier dryer portion, each dryer group is all the dryer cylinders engaging a pair of upper and lower dryer felts; a typical dryer or dryer section has several dryer groups.

As the web leaves a lower dryer cylinder to go to the next upper dryer cylinder, the felt and the lower dryer cylinder surface separate so the web can transfer to the top dryer cylinder. As the web is led away from both the lower dryer cylinder and the lower felt, it is not touching anything on either side as it follows a long path from one dryer cylinder to the other. Such a long, unsupported length of the web is called an open draw. When the web reaches the next upper dryer cylinder, the upper felt and the dryer cylinder surface come together, with the web between them, to bring the web into contact with the next upper dryer cylinder. Essentially the same procedure is followed to transfer the web from an upper dryer cylinder to a lower dryer cylinder.

In a double-felted double tier dryer, each transfer from one dryer cylinder to the next within a dryer group, or from one dryer group to the next, has required the introduction of an extended open draw, typically more than several feet (about a meter) long and at least about 16 inches (over 400 mm) long.

In a paper machine, the "machine direction" is the direction the paper is running through the length of the machine, and the "cross-machine direction" is the perpendicular direction across the width of the machine.

In open draws, the felt pressure continues to provide some restraint in the machine direction by maintaining a machine direction draw, but in the cross-machine direction, the paper is virtually unrestrained, so the sheet freely shrinks. This shrinkage is not uniform, and is greater at the edges of the sheet than in the middle, looking across the sheet. The edges shrink more because a region in the center of the sheet which shrinks is restrained by the structure of the paper on both sides, while a region on the edge which shrinks is not restrained on the outside because the paper ends at the edge. The result is uneven sheet properties across the width of the sheet, as well as edge cockles, graininess, and curl.

Cockles are defined in "The Dictionary of Paper" Fourth Edition, published 1980, as "a puckered condition of the sheet resulting from nonuniform drying and shrinking; it usually appears on paper that has had very little restraint during drying." Graininess is a large number of small variations in the surface appearance of a paper or board, resulting from any of a variety of causes, such as uneven shrinkage in drying. Curl is defined in "The Dictionary of Paper" Fourth Edition, published 1980, as "the curvature developed when one side of a paper specimen is wetted." Curl can also develop by heating the sheet, as in a photocopying machine.

The unsupported open draws also flutter, which is particularly a problem at the wet end of the dryer where the sheet is still very wet, and thus weak. Web flutter at the wet end can cause the web to break, and the machine must be cleaned out and re-threaded before it can be restored to service. The open draw thus creates runnability problems, particularly in the wet end of the dryer.

An early attempt to minimize undesirable open draws was the use of a single-felted double tier dryer group (sometimes known as a "serpentine" dryer group) in place of one of the double-felted double tier groups. In a serpentine dryer group, illustrated in FIG. 14, the dryer cylinders are again arranged in two tiers, and the web path is the same (from 100 to 104 to 101 to 105 to 102), but the web and a single felt follow the same path between the respective top and bottom cylinders.

The serpentine configuration, although reducing the problem of undesirable sheet flutter by eliminating open draws, introduces several disadvantages. First, the heat transfer from the bottom dryer cylinders is substantially reduced because the wet web is not in direct contact with the bottom cylinders. The felt is interposed between the web and the drying surfaces of the bottom cylinders. Second, the web has a tendency to sag or otherwise separate from the felt because the web travels outside the felt as it wraps around the bottom cylinder. The web can thus be influenced by the moving air and gravity, and can separate from the felt to form a bubble or flutter on the felt. Third, the initial threading of the web is not particularly easy. Further, the serpentine arrangement does not replace the open draws with positive restraint and it dries the sheet from one side only.

Others have attempted to improve the restraint applied between the top dryer cylinders of the serpentine section by inducing a vacuum along straight runs of the web by placing blow boxes next to the straight runs. But the vacuum induced in conventional serpentine blow boxes is typically only 0.1 to 0.2 inches water column (WC) (0.025–0.05 kPa), and this is clearly inadequate to provide significant shrinkage restraint. Additionally, such low level vacuum does not extend around the entire bottom dryer cylinder. With the longer sheet length between top dryer cylinders, the sheet is left unrestrained for a significant portion of the drying cycle in the conventional serpentine dryer group.

Serpentine felted two tier groups have not been continued all the way to the dry end of the dryer for an important reason—the dryer cylinders of each serpentine-felted group only directly contact one side of the web with the heated surfaces of dryer cylinders. In other words, a serpentine dryer group only directly dries one side of the paper.

Single-felted single tier construction has been developed to address some the problems of serpentine two-tier construction. In the single-felted single tier arrangement, dryer cylinders alternate with vacuum rolls and a single felt is wrapped around each dryer cylinder and vacuum roll in the group. Single-felted single tier dryer groups may be top-felted (meaning that the bottom surface of the web contacts each dryer cylinder and the felt and web run together over the top of each dryer cylinder) or bottom-felted (meaning that the top surface of the web contacts each dryer cylinder and the web and felt run together under each dryer cylinder). A portion of a "BelRun" dryer group consisting of three top-felted single tier dryer cylinders is illustrated by FIG. 15. "BelRun" is a registered trademark of Beloit Corporation.

Single-felted single tier construction is used in the wet end of the "BelRun" dryers sold by Beloit Corporation. In the "BelRun" groups, the bottom, ineffective dryer cylinders of the serpentine double-tier machine are replaced by vacuum rolls disposed below and between each pair of the dryer cylinders of a top-felted single tier of dryer cylinders. A felted run of the web passes from the preceding dryer cylinder to the vacuum roll, and then to the next dryer cylinder.

The draws between "BelRun" dryer cylinders and vacuum rolls are kept short to prevent the web from departing from the felt, and thus to eliminate or at least minimize flutter, when the web and felt pass from one dryer cylinder to the next vacuum roll. Each vacuum roll draws the web against the felt as the felt traverses the vacuum roll to restrain the web against the felt. The felt tension directly holds the felt against the dryer cylinder. The single tier dryer group thus positively keeps the web and felt together as it conveys the web through the group. Several top-felted single tier groups can be arranged in a series, with lick-down transfers between each group, so there is no open draw in the group to group transfer and there are no bottom-felted dryer cylinders in the series.

The serpentine and single tier dryer groups previously have been applied only to the wet end of the dryer. This has been done to improve runability, avoiding paper breaks and other mishaps during the manufacturing process.

The top-felted single tier dryer groups with no open draws provide improved runnability—the ability of the machine to process paper without breaks—which is particularly necessary in the wet end of the dryer. But the series of top-felted single tier dryer groups has not been continued all the way to the dry end of the dryer, because a series of like-felted (e.g. all top-felted) single-tier dryer groups connected by lickdown transfers only dries one side of the paper. This one-sided drying problem of the serpentine dryer group is not solved by providing a series of top-felted single tier dryer groups.

If one side of the paper is dried throughout the dryer, the resulting paper will have a tendency to curl as the result of heat, humidity and other factors. Paper which curls is inferior, and cannot be used for many purposes, such as photocopying or printing, where the paper must be fed through a machine after being heated or moistened. Thus, one-sided drying is discontinued in the dry end of the machine. One, more than one, or all double tier dryer groups are provided at the dry end of the dryer to reduce or substantially eliminate curl by drying both sides of the web. The shift from one-sided to two-sided drying has occurred before the web was 60% dry.

Another reason why single-felted groups have been discontinued in the dry end of the machine is that the paper is stronger there and can withstand open draws without losing its runnability.

Thus, dryer sections including multiple single-tier groups and no open draws in the wet end have been combined with conventional double felted two tier dryer groups in the dry end to complete drying. A typical dryer cylinder including single tier dryer groups has approximately 40 percent of the dryer cylinders in top-felted single tier groups, and the remaining approximately 60 percent of the dryer cylinders are two tier, double felted dryer cylinders.

One important consequence of discontinuing the single tier dryer groups before about 60% dryness (i.e. in the wet end of the dryer) is that the web was still dried substantially without restraint in the dry end (i.e. above about 60% dryness).

SUMMARY OF THE INVENTION

An object of the present invention is to provide a process that overcomes the aforementioned inadequacies of the prior art drying methods and to provide a process which makes a contribution to the art of paper drying.

Another object of the present invention is the provision of a process for the restrained drying of a paper web which restraining the web against cross-machine direction shrinkage during passage of the web past the guiding device so that edge curl of the web is inhibited.

Another object of the present invention is the provision of a process for the restrained drying of a paper web which reduces cockle and graininess of the sheet edges.

Another object of the present invention is the provision of a process which allows the slice opening to be more uniform, improving the cross-direction fiber orientation profile.

Other objects and advantages of the present invention will be evident from the detailed description contained hereinafter taken in conjunction with the various figures of the drawings and graphs and from the disclosure of the appended claims.

At least one of these objects is carried out, at least to some degree, by the present invention.

The present inventors have found that drying in the dry end without restraint causes nonuniform cross directional sheet shrinkage and other problems during conventional drying processes.

Accordingly, one aspect of the present invention is a papermaking machine including a forming section for forming a paper web, a press section for pressing water from the paper web, and a dryer for drying the paper web. The dryer includes a wet end for drying the paper web to at least about 60 percent solids and a dry end for further drying the paper web. The dry end includes at least one series of alternating dryer cylinders and vacuum rolls. (A "series" may be an entire group or less than an entire group.) This machine has a dryer felt. The dryer felt has a first side wrapped about each dryer cylinder and a second side wrapped about each vacuum roll of the series. The first side of the dryer felt transports the paper web as the dryer felt travels about each dryer cylinder and each vacuum roll of the series. In this embodiment, the vacuum apparatus is arranged to provide restraint by exerting a vacuum of at least about one inch water column (0.25 kilo-pascals, "kPa"), alternatively at least about two inches water column (0.5 kPa), alternatively at least about six inches water column (1.5 kPa) in at least one vacuum roll of the series. The vacuum levels defined here are measured conventionally, at the flange of the vacuum roll.

Another aspect of the invention is such a papermaking machine in which the dry end includes at least one complete dryer group of alternating dryer cylinders and vacuum rolls, of which the dryer cylinders are arranged generally in a single row.

Still another aspect of the invention is such a papermaking machine having at least one complete dryer group of alternating dryer cylinders and return rolls. The dryer felt includes at least one curved first run wrapped around a vacuum roll for restraining the web with vacuum, at least one straight second run extending between a vacuum roll and a dryer cylinder, and at least one curved third run wrapped around a dryer cylinder for restraining the web between the felt and the dryer cylinder.

Still another aspect of the invention is a method for manufacturing a paper web. A wet paper web is formed, and a dryer like those described above is provided to dry it. The paper web is pre-dried in the wet end to at least about 60 percent solids. The paper web and the dryer felt are then conveyed together along substantially the same path about each dryer cylinder and each vacuum roll of the series.

The vacuum level employed at the dry end of the dryer can be at least 1 inch water column (0.25 kPa), alternatively at least about 2 inches water column (0.5 kPa), alternatively at least about 4 inches water column (1 kPa), alternatively at least about 6 inches water column (1.5 kPa). No specific upper vacuum level is contemplated, though the level of vacuum used may be as high as 8 inches (2 kPa), alternatively 10 inches (2.5 kPa) or more, water column.

BRIEF DESCRIPTION OF THE DRAWINGS

Similar reference characters refer to similar parts throughout the various embodiments shown in the drawings.

DETAILED DESCRIPTION OF THE INVENTION

The present invention is not limited by the specific embodiments and steps described in the detailed description but rather is defined by the appended claims. Many variations and modifications beyond the scope of the specific embodiments described here may be made by those skilled in the art without departing from the spirit and scope of the present invention as defined by the appended claims.

Figure 20:
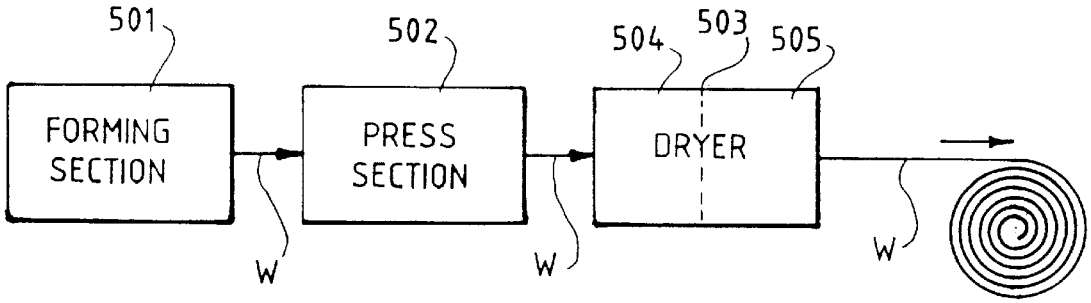
FIG. 20 is a block diagram showing the basic parts of a papermaking machine.

Referring first to FIG. 20, a papermaking machine, whether of the present invention or the prior art, includes a forming section 501 for forming a paper web W; a press section 502 for pressing water from the paper web W; and a dryer 503 for drying the paper web W. The dryer 503 has a wet end 504 which contacts the paper first and dries the paper web W to at least about 60 percent solids. The dryer 503 has a dry end 505 for further drying the paper web W beyond about 60 percent solids. The focus of this invention is on the type of dryer groups and degree of restraint used in the dry end 505 of the dryer 503.

Figure 1:
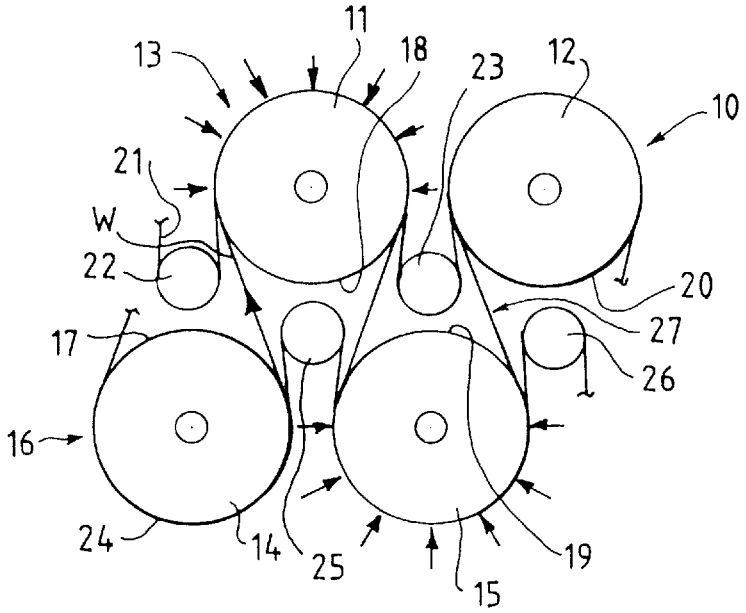
FIG. 1 PRIOR ART
FIG. 1 is a side-elevational view of a typical prior art double-felted dryer.

FIG. 1 is a side-elevational view of a portion of a typical prior art double-felted dryer group generally designated 10. The group 10 has dryer cylinders 11 and 12 defining an upper tier generally designated 13; these dryer cylinders directly dry the bottom side of the web. The lower dryer cylinders 14 and 15 define a lower tier generally designated 16; these dryer cylinders directly dry the upper side of the web. The web W wraps around the dryer cylinders 14, 11, 15 and 12 in that order so that alternate sides of the web are dried as they come into contact with the respective external surfaces 17, 18, 19 and 20 of the dryer cylinders 14, 11, 15 and 12. An upper felt 21 extends around a guide roll 22, then around the dryer cylinder 11, then around a further guide roll 23 and the upper dryer cylinder 12. Similarly, a lower felt 24 extends around the dryer cylinder 14, a lower guide roll 25, the dryer cylinder 15, and then another lower guide roll 26.

Although this prior art dryer provides sheet restraint during passage around the respective upper and lower dryer cylinders 11, 12, 14 and 15, the web is unsupported and therefore unrestrained against shrinkage during transit of the web W between (for example) the dryer cylinders 15 and 12. Such an unsupported length of the web passing from one roll to the next is known in the art as an open draw, such as 27. Because the web W is unsupported and unrestrained during transit through the open draws such as 27, uneven cross-machine direction shrinkage of the web occurs with the attendant edge curl, graininess, and edge cockles.

Figure 14:
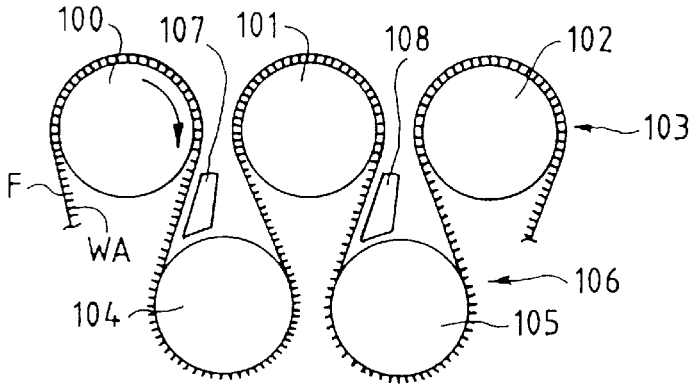
FIG. 14 is a diagrammatic side-elevational view of a single felt dryer or serpentine dryer.

A common commercial arrangement for eliminating open draws in the wet end of the dryer is the single felt or serpentine dryer shown in FIG. 14. In FIG. 14 the dryer cylinders 100, 101 and 102 constitute a upper tier generally designated 103. The dryer cylinders 104 and 105 constitute a lower tier 106. A joint run of the web WA and felt F extends in serpentine configuration respectively around the dryer cylinders 100, 104, 101, 105 and 102. Although the blow boxes 107 and 108 draw the web toward the felt during transit of the web between dryer cylinders, the applied vacuum is insufficient to cause any appreciable restraint of the web. The vacuum which is induced by conventional serpentine blow boxes is typically only 0.1 to 0.2 inches water column (0.025–0.05 kPa). Additionally, this low level vacuum does not extend around the entire bottom dryer cylinder. With the long sheet length between top dryer cylinders, the sheet is left unrestrained for a significant portion of the drying cycle in the conventional serpentine dryer.

Although the serpentine arrangement of FIG. 14 does eliminate the open draws, it does not replace the open draws with positive restraint and it dries the sheet from one side only throughout the group.

Figure 15:
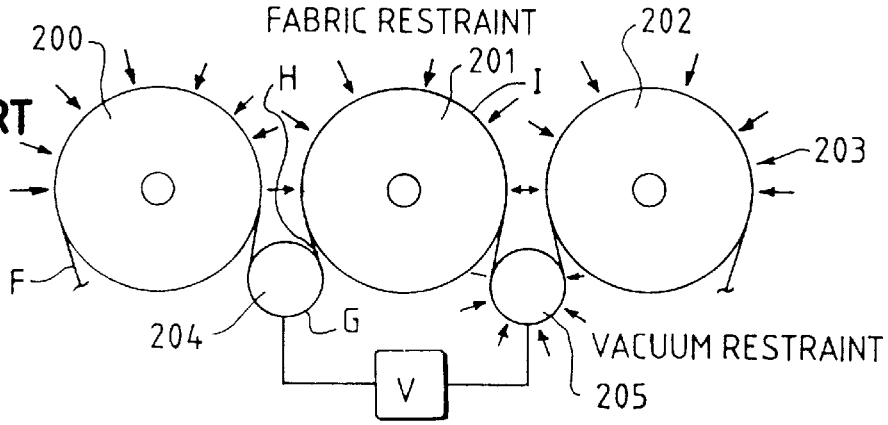
FIG. 15 PRIOR ART
FIG. 15 is a diagrammatic side-elevational view of a BEL RUN single tier dryer group as described in our U.S. Pat. No. 4,934,067.

FIG. 15 shows one group of a single tier dryer group including several dryer cylinders 200, 201 and 202 arranged as a single tier generally designated 203. Interposed between the dryer cylinders 200 and 201 is a vacuum guide roll 204. Furthermore, another vacuum guide roll 205 is disposed between the dryer cylinders 201 and 202. In this design, the bottom ineffective dryer cylinders of the serpentine section shown in FIG. 14 have been eliminated and replaced with vacuum rolls 204 and 205. Two-sided drying is maintained in this arrangement by alternating between top-felted and bottom-felted single tier groups as shown in our U.S. Pat. No. 4,934,067.

The dry end shown in part in FIG. 15 includes at least one series of alternating dryer cylinders and vacuum rolls 200, 204, 201, 205, and 202. A dryer felt F has a first (bottom) side wrapped over the top of each dryer cylinder 200–202 and a second (top) side wrapped under each vacuum roll 204, 205 in series. The first side of the dryer felt F is adapted for transporting the paper web W (not shown in FIG. 15, but positioned against the bottom side of the dryer felt) through the dryer group, where it travels about each dryer cylinder and each vacuum roll of the series. Vacuum apparatus V is adapted and operatively connected to provide a vacuum of at least about 1 inch water column (0.25 kPa) in at least one vacuum roll, and here in both vacuum rolls 204 and 205 of the series.

The intermediate vacuum rolls 204 and 205 of the single tier group 203 act much like the felt vacuum box used in the laboratory studies discussed below. This vacuum maintains the restraint which is applied by the dryer felt pressure as the sheet is transferred between dryer cylinders.

A vacuum level of 6 to 8 inches WC (1.5–2 kPa) in the vacuum rolls is essentially equal in magnitude to the pressure which is applied to the web by the dryer felt. It is also a desirable vacuum level for positive sheet restraint.

In the context of the present invention, the series of alternate dryer cylinder rolls and vacuum rolls and the dryer felt according to the present invention can define one entire dryer group or less than an entire group.

The vacuum apparatus V of the dry end dryer group of FIG. 15 can alternatively be connected to at least two of the vacuum rolls of the series, or a majority of the vacuum rolls of the series, or all of the vacuum rolls of the series. The vacuum apparatus can be one source of vacuum connected to all of the vacuum rolls of the series, or one vacuum source for each vacuum roll, or more than one separate vacuum apparatus together serving the vacuum rolls.

The dryer cylinders of the dry end group can be arranged in a single row, as shown in FIG. 15, although one, more than one, or all of the dryer cylinders of the group can be out of line within the scope of the present invention. The row of dryer cylinders is preferably substantially horizontal, but can progressively rise or fall within the scope of the present invention.

Still referring to FIG. 15, the dryer felt F of the single tier group 203 can include at least one curved first run G wrapped around a vacuum roll 204 supplied with vacuum at a vacuum level of at least 1 inch water column (0.25 kPa) for restraining the web W with vacuum along the curved first run. The felt F also has at least one straight second run H (which is very short) extending between a vacuum roll such as 204 and a dryer cylinder 201. The felt F has at least one curved third run I wrapped around a dryer cylinder such as 201 for restraining the web between the felt and the dryer cylinder.

The dry end can include one, two, three, or more groups of alternating dryer cylinders and vacuum rolls. One, more than one, or all of the groups can have a dryer felt having a first side wrapped about each dryer cylinder and a second side wrapped about each vacuum roll. The first side of one, more than one, or all of the felts can be adapted for transporting the paper web as the dryer felt travels about each dryer cylinder and each vacuum roll of the second series. Vacuum apparatus can be connected to at least one of the vacuum rolls of at least one of the several series of vacuum rolls.

The wet end, similarly, can have a variety of different configurations. In one embodiment the wet end 504 of the dryer 503 can include one or more than one series of alternating dryer cylinders and vacuum rolls. One, more than one, or all of those series can be served by a dryer felt having a first side wrapped about each dryer cylinder and a second side wrapped about each vacuum roll in the wet end series. The first sides of one, more than one, or all of the wet end felts can be adapted for transporting the paper web as the wet end felt travels about each dryer cylinder and each vacuum roll of a series. Vacuum apparatus can be connected to at least one of the vacuum rolls of at least one of the several series of vacuum rolls.

The method for manufacturing a paper web contemplated here is begun by forming a wet paper web W, which can be done with a conventional forming section 501, although the variation in basis weight across the slice profile can be reduced according to the present invention. A dryer 503 having a wet end 504 and a dry end 505 is provided, as described above. The dry end 505 of the dryer 503 includes at least one series of alternating dryer cylinders and vacuum rolls and a dryer felt having a first side wrapped about each dryer cylinder and a second side wrapped about each vacuum roll in the series, as illustrated in FIG. 15. The web can be dried in the wet end of the dryer at least until a threshold dryness level is reached at which the rate of cross-machine direction shrinkage of an identically-formed web would increase substantially if it were dried without restraint. The threshold dryness commonly is at least about 60 percent solids, with some variation (expressed by the word "about") as the result of the particular furnish or pulp slurry and other processing conditions which are used.

At least in the dry end 505 of the dryer, the paper web is deposited on the first side of the dryer felt of a series of dryer cylinders and vacuum rolls. The paper web and dryer felt are conveyed together along substantially the same path about each dryer cylinder and each vacuum roll of the series. A vacuum of at least about 1 inch water column (0.25 kPa) is provided to at least one of the vacuum rolls of the series, alternatively to at least two vacuum rolls of the series, alternatively to at least a majority of the vacuum rolls of the series, alternatively to each vacuum roll of the series. Higher vacuum levels, as defined above, may also be used in one or more vacuum rolls. Tension is applied to the dryer felt as it wraps about at least one of the dryer cylinders of the series, alternatively about at least two dryer cylinders of the series, alternatively about at least a majority of the dryer cylinders of the series, alternatively about each dryer cylinder of the series.

The vacuum levels, and thus the degree of restraint, in the dry end of the dryer can also be regulated to provide certain properties of the web, such as desirably lower and more uniform shrinkage, stretch, tensile strength and ratio, tensile energy absorption, and hygroexpansivity and better fiber orientation than are achieved when the web is inadequately restrained in the dry end of the dryer. Those web properties will be illustrated with reference to FIGS. 2 through 9, 13, 16, 17, and 18 for a web dried without restraint in the dry end. The properties of a web dried with restraint in the dry end, according to the present invention, will be compared with reference to FIGS. 10–13, 17, and 19.

Shrinkage

Figure 2:
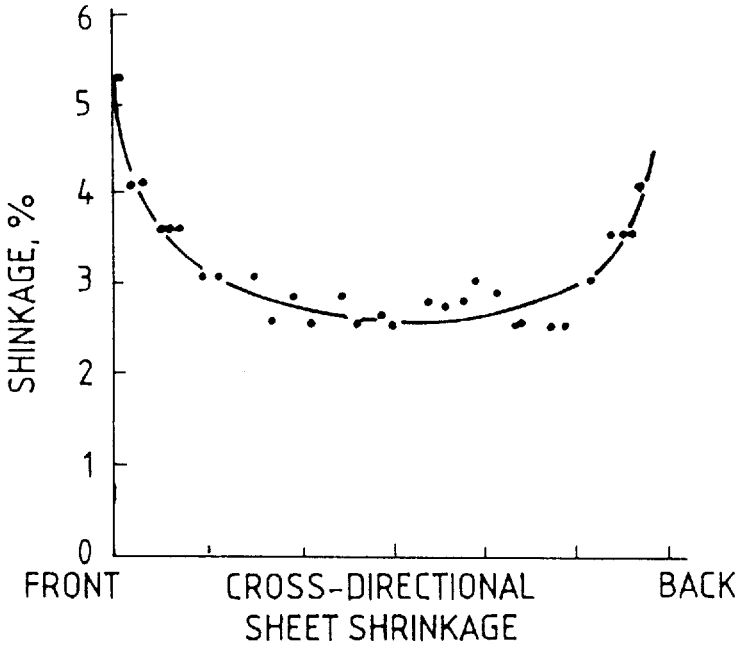
FIG. 2 is a graph showing the percentage of shrinkage in the cross-machine direction (from one edge of the sheet to the other, or from the front of the sheet to the back) for paper dried without restraint.

FIG. 2 is a graph showing the shrinkage of the web across a sheet dried without restraint. Shrinkage is measured by determining how much the web has drawn up or contracted in the cross-machine direction as it is dried, expressed as a percentage of the original dimension of the web. In the graph of FIG. 2, the x axis (horizontal scale) includes readings taken at different points from the front edge to the back edge of the sample web.

The amount of shrinkage at each point (vertical scale) is shown as a percentage of the initial width.

When the web is dried without restraint, the shrinkage is found to be highly nonuniform, with the plot being almost parabolic. The highest shrinkage is found to occur at the edges of the paper (represented by the left and right ends of the plot), where the sheet has the least cross-directional restraint. The sheet shrinkage is the lowest near the center of the paper (represented by the middle of the plot), where the center of the paper is at least partly restrained from shrinking by the outer portion of the sheet.

Figure 16:
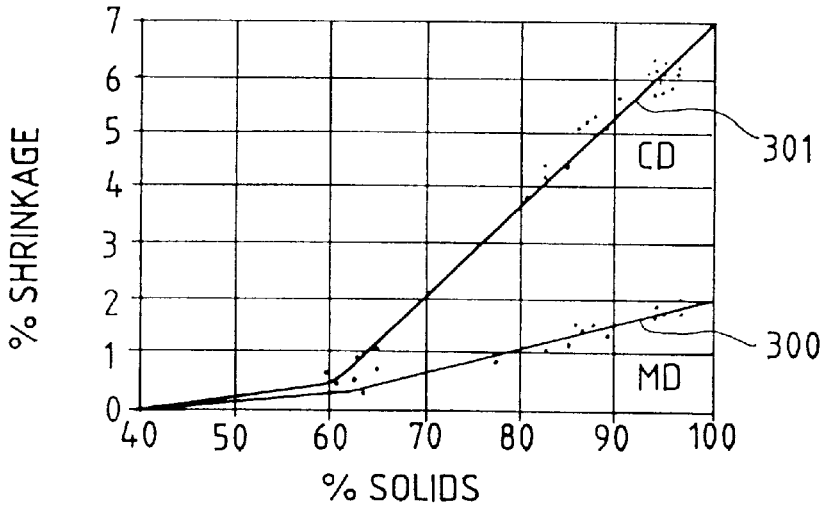
FIG. 16 is a graph showing sample shrinkage characteristics in the machine direction and in a cross-machine direction respectively.

The propensity of a web to shrink also depends on how dry the web is, and thus where it is in the dryer. Referring to FIG. 16, for a particular furnish the cumulative machine direction and cross-machine direction shrinkage were measured as a function of the water content of the web. The results are provided by plots 300 (machine-direction or "MD" shrinkage) and 301 (cross-machine-direction or "CD" shrinkage), respectively. The cumulative shrinkage was very low as the sheet was dried from 40 percent dry (the dryness near the beginning of the wet end 504) to 60 percent dry. Once the sheet reached 60% dry, the cumulative shrinkage increased dramatically and continued to increase at a high rate until the sheet was essentially dry. This sudden increase is represented by the sudden upward bend or discontinuity at 60% solids in the plot 301.

FIG. 16 demonstrates that shrinkage is not a significant problem in the wet end of the dryer, which for this furnish is the portion of the dryer which dries the web up to about 60% dryness. Shrinkage becomes a substantial problem in the dry end of the machine, which under the present conditions is the portion of the machine drying the web from about 60% dryness onward. This data specifically points out the need for sheet restraint in the dry end of the dryer.

The dry end of the machine, for a particular machine, furnish, and operating conditions, unless numerically defined by a percent dryness, is defined herein as beginning at the dryness at which the rate of cross-machine direction shrinkage would increase substantially if the web were dried without vacuum restraint.

To show the benefit of vacuum restraint to limit shrinkage, paper samples were manufactured on pilot twin-wire machines at commercial speeds. These sheets were then freely dried on a dryer felt which was supported by a vacuum box. Separate sheets were dried with different levels of vacuum in the box to provide different levels of sheet shrinkage restraint.

Figure 10:
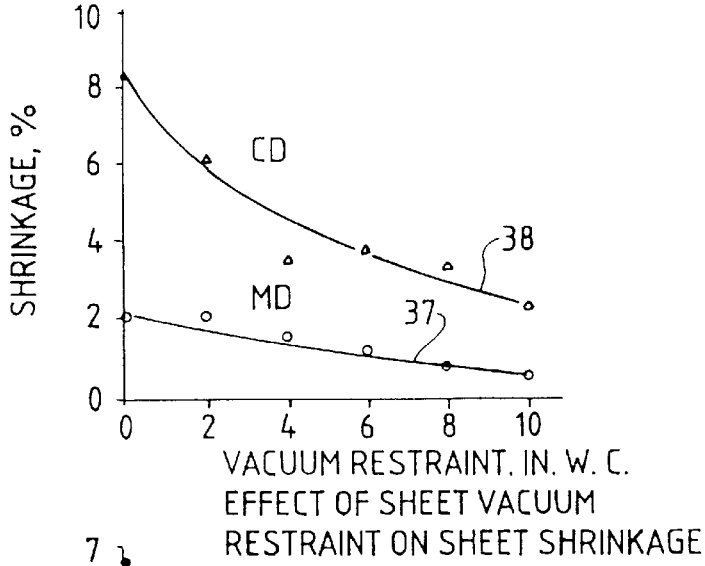
FIG. 10 is a graph comparing machine direction to cross-machine direction shrinkage without vacuum to shrinkage with various levels of vacuum restraint.

The results of this test are provided in FIG. 10, which shows the effect of sheet vacuum restraint on sheet shrinkage in the machine direction, as shown by plot 37, and for the cross-machine direction, as shown by plot 38. With no vacuum in the box, represented by zero inches (WC) (0 kPa) of vacuum on the horizontal scale, the machine made sheet was able to shrink without vacuum restraint. The overall cross-machine-direction shrinkage of the unrestrained sheet was over 8%.

Providing a vacuum in the vacuum box restrained the web from shrinking. Still referring to FIG. 10, the cross-machine-direction shrinkage at a vacuum level of two inches WC (0.5 kPa) dropped to roughly 6%. At vacuum levels of 4, 6, and 8 inches WC (1, 1.5, and 2 kPa), the cross-machine-direction shrinkage dropped to less than about 4%. At a vacuum level of 10 inches WC (2.5 kPa), the cross-machine-direction shrinkage dropped to less than about 3%. The machine-direction shrinkage also dropped as higher levels of vacuum restraint were applied. Thus, the level of vacuum can be adjusted to reduce the overall cross-machine direction shrinkage of the web to at most about 4%, alternatively at most about 3%.

Comparing FIGS. 2 and 10, the cross-machine direction shrinkage is about 3% in the center of the sheet without restraint, and about 3% across the entire sheet with 10 inches WC (2.5 kPa) of vacuum restraint. This indicates that, according to the present invention, the level of vacuum can be sufficient to reduce the cross-machine direction shrinkage of the entire web substantially to the cross-machine direction shrinkage of the center of the web when dried without restraint.

Just considering FIG. 10, the level of vacuum can be sufficient to reduce the overall cross-machine direction shrinkage of the web by at least about half, compared to the overall cross-machine direction shrinkage of an identically formed web which is dried without restraint (i.e. from 8% shrinkage with no vacuum to about 4% shrinkage with 4–8 inches WC (1–2 kPa) of vacuum).

The reduction in shrinkage also reduces the susceptibility of the sheet to develop curl, cockle, and grainy edges.

Stretch

Figure 3:
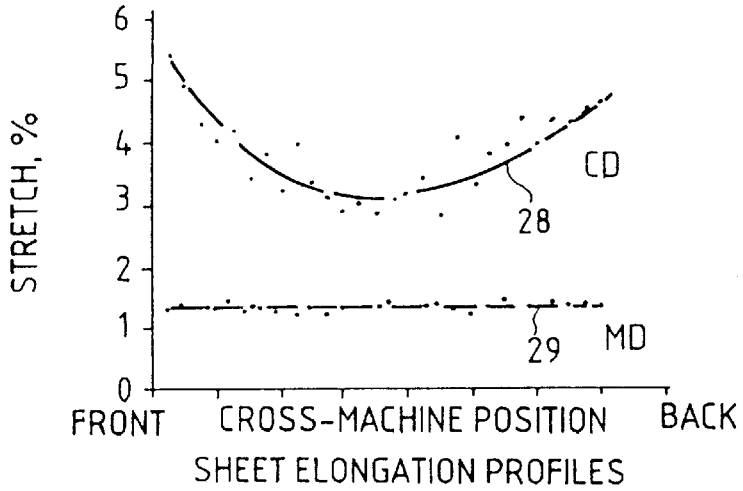
FIG. 3 is a graph comparing sheet elongation profiles in the machine direction and the cross-machine direction for paper dried without restraint.

FIG. 3 is a plot showing stretch testing results for a cross-directional paper sample dried without restraint, then tested in the laboratory to determine the variations in sheet stretch. Stretch is defined in "The Dictionary of Paper" Fourth Edition, published 1980, as "the elongation corresponding to the point of rupture in a tensile strength measurement; it is usually expressed as a percentage of the original length." Unlike shrinkage, which compares a dimension of the sheet before and after drying, stretch is measured on the dry web by seeing how far the paper can stretch, when pulled, before it ruptures (tears).

As shown in FIG. 3, the machine direction and cross-machine direction sheet stretch profiles are demonstrated. The machine direction stretch is very uniform in the cross direction because it is controlled by the machine direction draws. However, the cross-machine direction stretch is very nonuniform, as shown by the plot. From a comparison of the plot 28 with the plot 29 of the machine direction, it appears there is a direct reflection of the cross-direction shrinkage, that is the highest stretch occurs at the edges where the sheet has experienced the greatest shrinkage.

Figure 11:
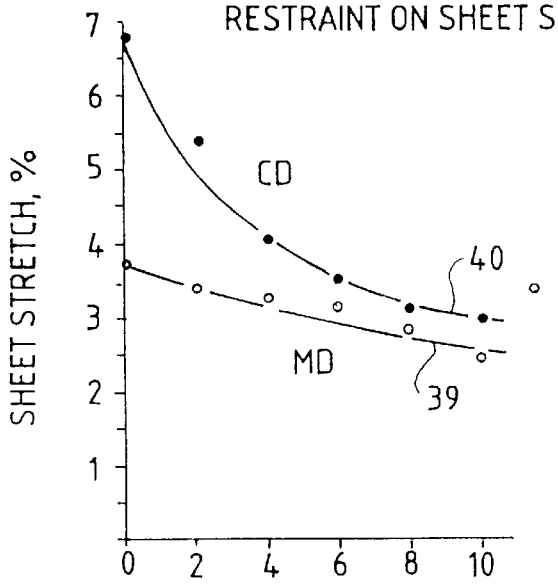
FIG. 11 is a graph similar to that shown in FIG. 10, but showing the effect of sheet vacuum restraint on sample stretch.

When the web is dried under restraint, the sheet stretch is reduced. FIG. 11 shows the effect of various levels of sheet vacuum restraint, identified on the horizontal scale, on sample stretch, which is on the vertical scale. The paper for FIG. 11 was made in the same manner as the paper used in FIG. 10. FIG. 11 includes a plot 39 for the machine direction stretch and a plot 40 for the cross-machine direction stretch.

Looking at the plot 40, the cross-machine direction stretch is reduced from nearly 7% with no vacuum to about 3% at 10 inches WC (2.5 kPa) of vacuum. The level of vacuum is sufficient to reduce the overall cross-machine direction stretch of the web to at most about 3.6%, alternatively to at most about 3%. Comparing FIGS. 3 and 11, the level of vacuum can be sufficient to reduce the percent cross-machine direction stretch of the entire web (FIG. 11) substantially to the percent cross-machine direction stretch of the center of the unrestrained web (FIG. 3, center).

Alternatively, the level of vacuum can be sufficient to reduce the overall cross-machine direction stretch of the web by at least about 43%, alternatively at least about 46%, compared to the overall cross-machine direction stretch of an identically formed web which is dried without restraint. The machine-direction stretch, plot 39, also is reduced when vacuum is applied during drying.

Tensile Strength Profile

Figure 4:
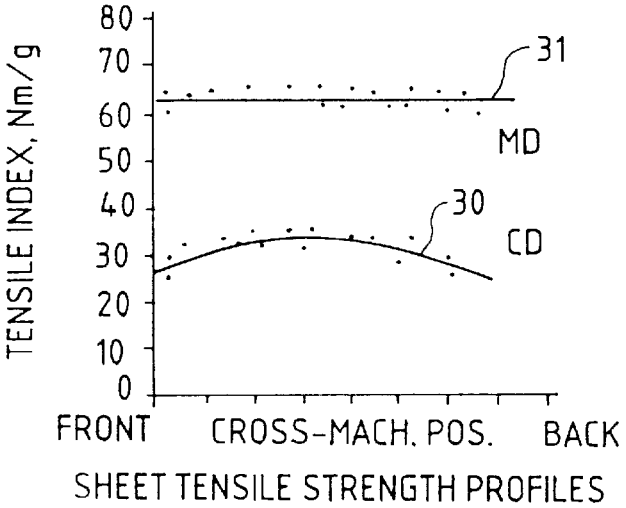
FIG. 4 is a graph comparing the sheet tensile strength profiles in the machine direction and the cross-machine direction for paper dried without restraint.
Figure 5:
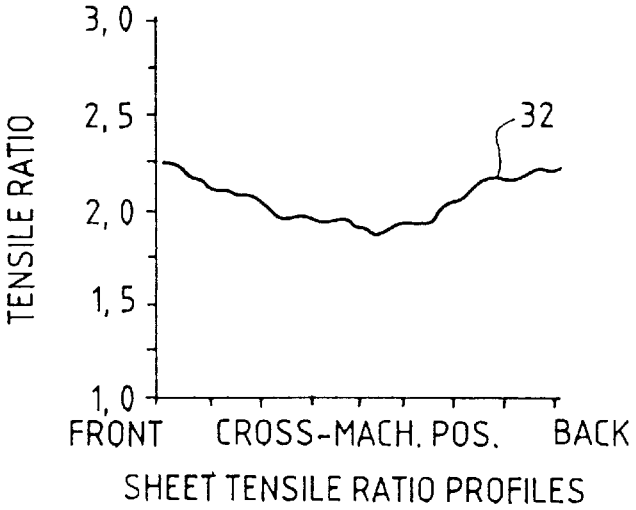
FIG. 5 is a graph showing the sheet tensile ratio profile from the front to the back edge of the sheet for paper dried without restraint.

The graph shown in FIG. 4 includes a plot 30 of the sheet tensile strength profiles for the cross-machine direction and the plot 31 for the machine direction for a sheet dried without restraint. The machine direction tensile as shown in FIG. 4 is fairly uniform, again being affected in part by the machine direction draw which does not vary in the cross-direction. The cross-direction tensile profile, however, is nonuniform. It exhibits a slight "frown" or hyperbolic shape. The lowest tensile strength profile occurs near the sheet edges again where the cross-machine direction shrinkage is the greatest. Since the cross-machine direction tensile varies in the cross direction, while machine direction tensile remains fairly uniform, the tensile ratio also varies, with the highest ratio occurring at the edges as shown by the tensile ratio plot 32 shown in FIG. 5.

Figure 12:
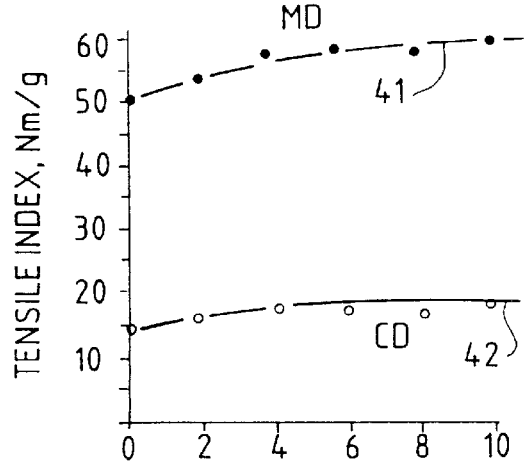
FIG. 12 is a graph similar to that shown in FIG. 10, but showing the effect of sheet vacuum restraint on sample tensile strength.

FIG. 12 shows the effect of vacuum restraint on the tensile strength profile of a sample, with the machine direction plot being 41 and the cross-machine direction plot being 42. The application of vacuum particularly caused the machine direction properties and the cross-machine direction tensile properties to increase, which is an improvement because the paper is stronger.

Tensile Energy Absorption

Figure 6:
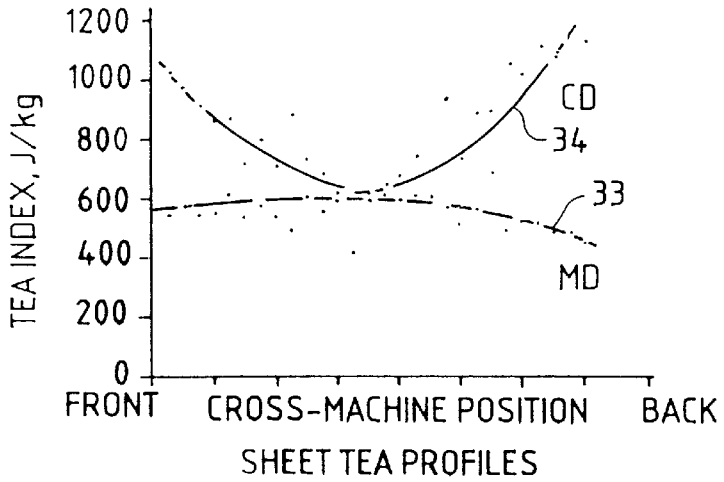
FIG. 6 is a graph showing the sheet tensile energy absorption (TEA) profiles from the front to the back edge of the sheet for the machine direction and the cross-machine direction, respectively, for paper dried without restraint.

FIG. 6 shows two plots 33 and 34, showing the tensile energy absorption (TEA) properties of a sheet dried without restraint. The plot 33 demonstrates the sheet TEA profile in the machine direction. The plot 34 shows the sheet TEA profile for the cross-machine direction.

Tensile energy absorption (TEA) is defined as the energy absorbed when a paper specimen is stressed to rupture under tension. It is useful in evaluating packaging materials subject to rough handling. A high tensile energy absorption is a favorable property because it indicates paper which will not easily tear.

The cross-machine direction profile shown in FIG. 6 reflects the non-uniformity in the cross-machine direction. The TEA profile, however, does not exhibit quite as much variation as the cross-machine direction stretch because the loss in stretch near the machine center is partly offset by the increase in the tensile strength.

Figure 13:
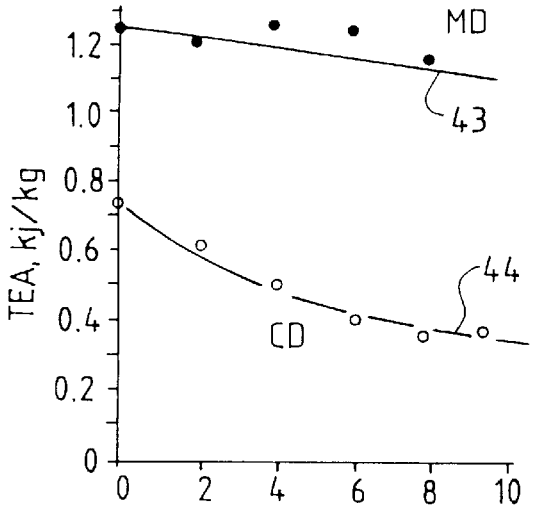
FIG. 13 is a graph similar to that shown in FIG. 10, but showing the effect of sheet vacuum restraint on sample TEA.

FIG. 13 shows the effect of sheet vacuum restraint on sample TEA with graph 43 indicating machine direction and graph 44 showing cross-machine direction. Note that FIG. 13, particularly graph 44, illustrates a reduction in cross-machine direction tensile energy absorption of the web to about 0.4 kJ/Kg and below for particular levels of vacuum restraint.

Slice Profile and Sheet Fiber Orientation Profile

The increased shrinkage which occurs near the edges can also have an adverse effect on the headbox performance. In order to achieve a level basis weight profile at the reel, the headbox slice opening must be reduced near the edges to recompensate for the edge shrinkage. Such closing down near the edges of the slice opening reduces the basis weight at the edges to compensate for the higher shrinkage which occurs near the edges.

Basis weight is defined as the weight in pounds of a ream cut to a specified basis size. In order to produce a level basis weight profile at the reel, the slice opening must be closed down near the edges, initially reducing the basis weight at the edges, to compensate for the higher shrinkage which occurs near the edges. This causes the paper to go through the press section and early dryer with light edges which eventually heavy up as the edges shrink.

The nonuniform slice opening is known to cause a distortion of the fiber orientation by inducing cross flows in the moving furnish or slurry which becomes the web. The fiber orientation can be determined for a sample of paper by measuring the sonic modulus profile as discussed below. The fiber orientation is indicated as the angle of the primary axis of the modulus envelope from the machine direction. A positive angle indicates the fibers are oriented toward the back side of the web and a negative angle indicates the fibers are oriented toward the front side of the web.

Figure 7:
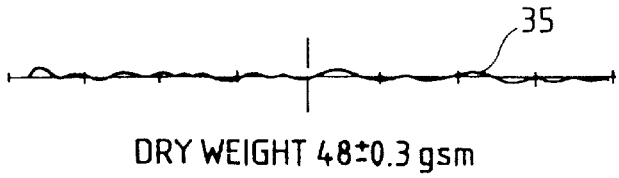
FIG. 7 is a graph showing the dry weight of a sheet which is essentially uniform from its front edge to its back edge.

FIG. 7 is a plot 35 showing the dry weight of a sample sheet which has a level basis weight from its front edge to its back edge.

Figure 8:
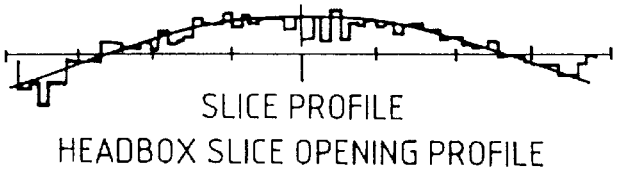
FIG. 8 shows a slice profile of a headbox with the opening profile necessary to obtain a uniform dry weight profile as shown in FIG. 7 after drying the paper without restraint.

FIG. 8 is a graph showing the slice profile required to obtain the result shown in FIG. 7 for a web dried without restraint. As shown in FIG. 8 the slice openings are reduced at the respective edges to obtain a relatively uniform resultant web after shrinkage.

Figure 9:
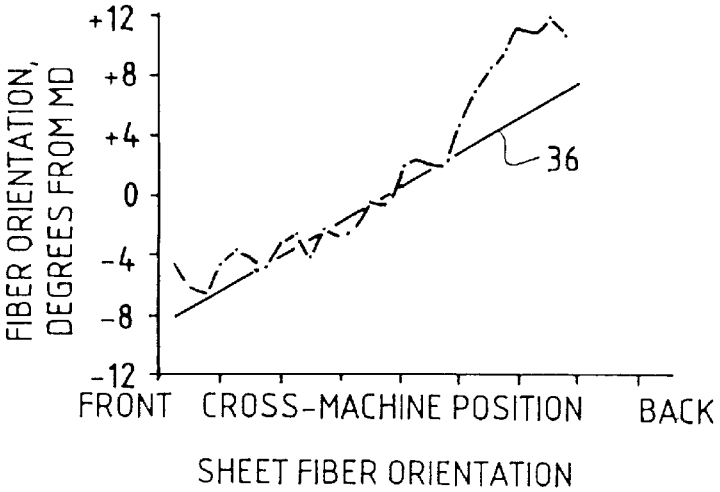
FIG. 9 is a graph showing sheet fiber orientation profile from the front to the back edge of the sheet formed as shown in FIGS. 7 and 8.

The fiber orientation is determined for the sample by measuring the sonic modulus profile. The profile is shown in FIG. 9, which is a plot from the front to the back of the sheet. The plot indicates actual readings whereas the plot 36 shows the average orientation. The fiber orientation is indicated as the angle of the primary axis of the modulus envelope from the machine direction.

In the sample used, the fibers were all oriented toward the center of the paper, and away from the front and the back of the sheet. Because the slice opening is closed down near the edges to compensate for edge shrinkage, nonuniformity in the fiber orientation profile is expected to occur.

In order to achieve a level weight profile without a seriously nonuniform slice opening, and in order to produce a sheet with uniform cross-direction property profiles, it is necessary to control the cross-machine direction shrinkage. Since the shrinkage occurs as the moisture is removed, the majority of the shrinkage takes place in the open draws where the water flashes. In order to reduce the shrinkage, the open draws must be replaced by a means of positive restraint as exemplified in our U.S. Pat. No. 4,934,067.

Figure 18:
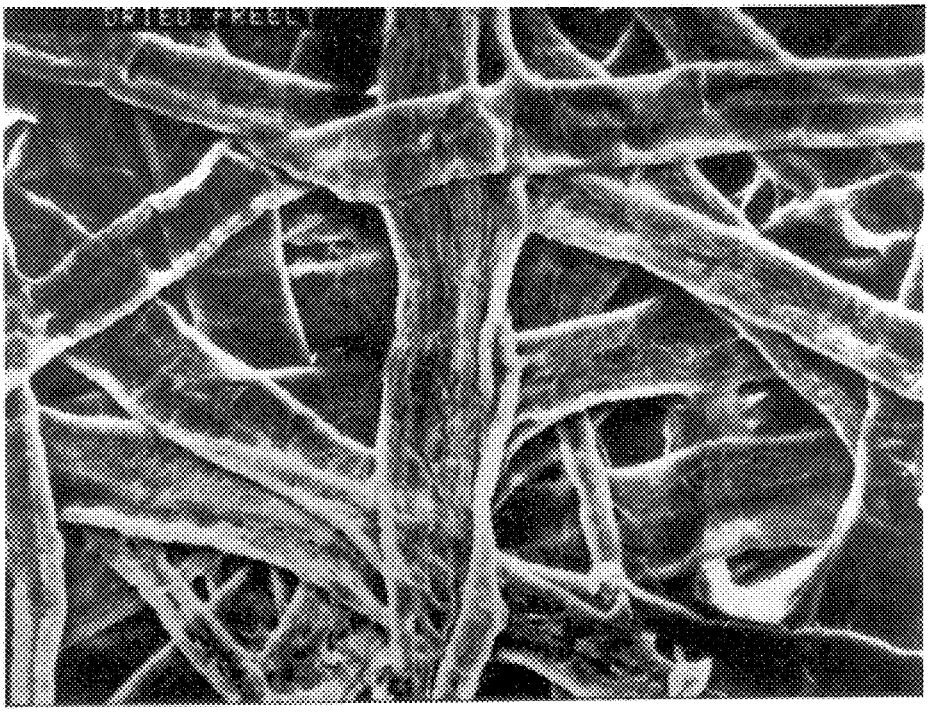
FIG. 18 is an enlarged photographic view of the surface of a freely dried sheet.
Figure 19:
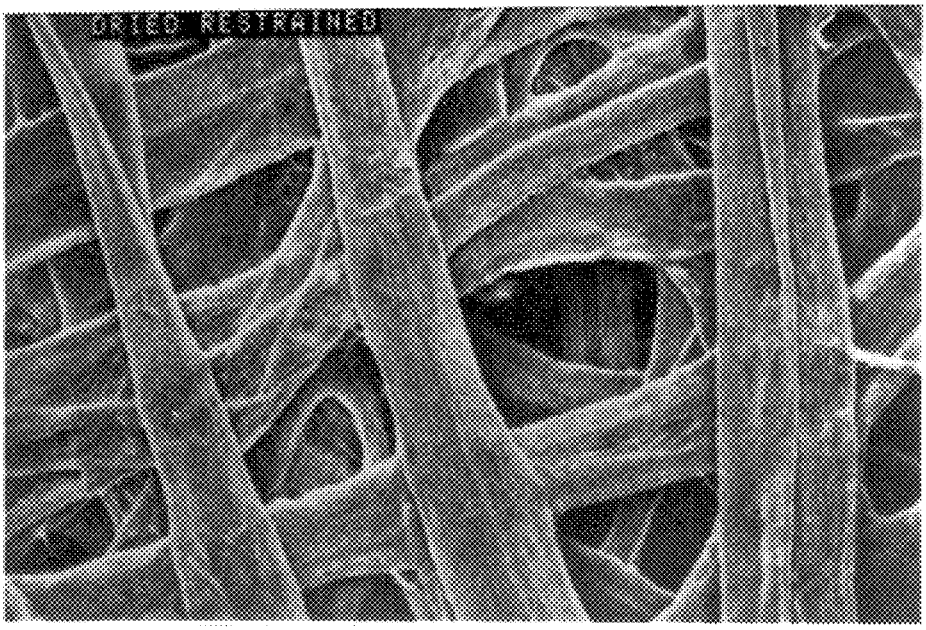
FIG. 19 is a view similar to FIG. 18 showing the surface of a sheet dried under restraint.

The photomicrographs shown in FIGS. 18 and 19 compare the fiber surface characteristics of a sheet dried under partial restraint, to a sheet dried unrestrained. These micrographs show a reduction in fiber kinks and flatness, indicating the fundamental effect of drying restraint on sheet structure as seen in laboratory dried samples.

Hygroexpansivity

In addition to the previously discussed improvements in sheet quality resulting from sheet restraint during drying, recent work has indicated that sheets dried under restraint exhibit a significant improvement (reduction) in hygroexpansivity. Hygroexpansivity is defined in "The Dictionary of Paper" Fourth Edition, published 1980, as "the change in dimension of paper that results from a change in the ambient relative humidity; it is commonly expressed as a percentage and is usually several times higher for the cross direction than for the machine direction. This property is of great importance in applications where the dimensions of paper sheets and cards or construction board (wallboard, acoustical tile, etc.) are critical." The susceptibility of the sheet to develop curl, cockle, and grainy edges is induced by hygroexpansivity and aggravated by non-uniformities in the Z direction (i.e. through the thickness of the paper) by the density, filler distribution, fines distribution, and fiber orientation. By reducing the hygroexpansivity, these defects can be greatly reduced or eliminated.

Figure 17:
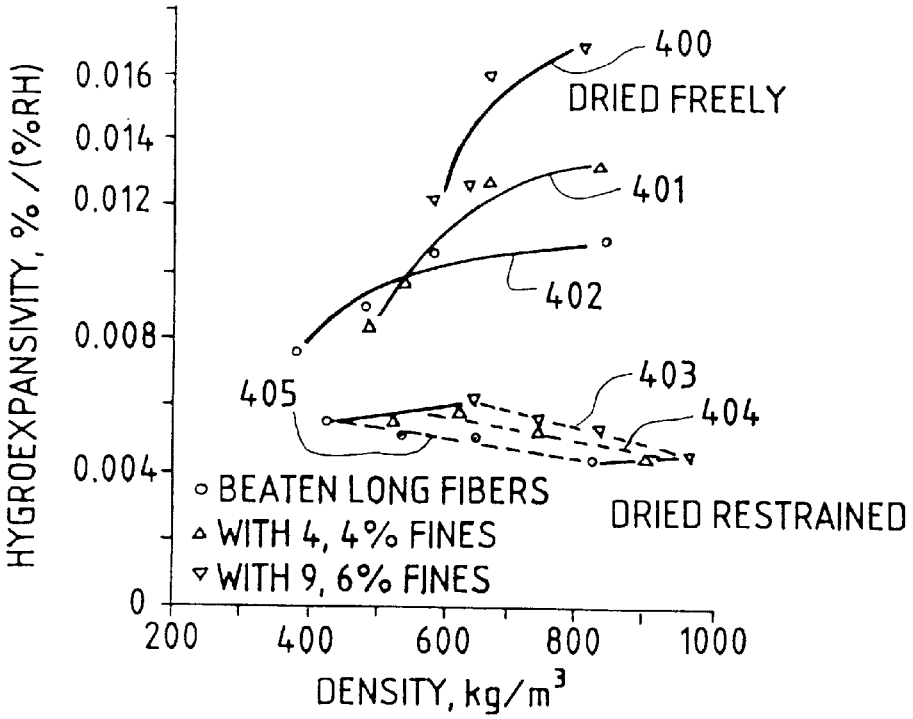
FIG. 17 is a graph showing the effect of restrained drying compared to nonrestrained drying on hygroexpansivity.

In FIG. 17, the plots 400, 401, and 402 represent paper that was dried without restraint; these samples had a high hygroexpansivity. The plots 403, 404, and 405 represent paper dried under restraint. FIG. 17 shows that the sheet is more stable (less hygroexpansive) when it is dried under restraint and also that the sheet hygroexpansivity is virtually unaffected by changes in sheet density, that is from pressing and fines content as a result of the refining.

FIG. 17 shows that the level of restraint can be sufficient to reduce the hygroexpansivity of the web to at most about 0.006 percent per percent relative humidity. FIG. 17 also shows a level of restraint sufficient to reduce the hygroexpansivity of the web by at least about 40%, compared to the hygroexpansivity of an identically formed web which is dried without restraint.

Conclusion

The above data clearly demonstrates that the cross-machine-direction properties of a sheet which is unrestrained during drying vary markedly between the edges and middle of the sheet. The cross-directional sheet shrinkage which occurs during the drying process is highly nonuniform. This nonuniform shrinkage directly affects the cross-machine direction stretch, tensile, modulus and TEA profiles. The greatest shrinkage occurs near the edges. In order to achieve a level basis weight profile at the reel, the headbox slice opening must be reduced near the edges to compensate for the edge shrinkage. The nonuniform shrinkage thereby indirectly affects fiber orientation. Non-uniform properties across the sheet are undesirable, as the end use of the paper typically requires uniform properties.

As FIG. 16 shows, the greatest shrinkage occurs in the dry end of the dryer. FIGS. 10–13 show that shrinkage can be reduced to a large degree by restraining the web as it is dried. The sheet properties shown in FIGS. 10 to 13 for stretch, tensile, modulus and TEA versus restraint are also observed in mill trials.

The problems of unrestrained drying can be addressed by restraining the web in the dry end of the machine. Dry end restraint can be applied conveniently and effectively in a single tier dryer, which provides felt restraint around the dryer cylinders and vacuum restraint around the vacuum rolls.

Since single tier groups are useful in the dry end of the dryer for improved paper properties, and in the wet end of the dryer for best runability, the single tier dryer configuration can be applied to essentially the entire dryer, in the manner disclosed in our U.S. Pat. No. 4,934,067. Thus, one or more single tier dryer groups with intermediate vacuum rolls, positioned in the dry end of the dryer, can be used to control the cross-machine direction shrinkage. Vacuum levels in the intermediate rolls or guide rolls in the range of as little as 1 inch WC (0.25 kPa), optimally 6 to 8 inches WC (1.5–2 kPa), and optionally more will continue the restraint applied by the dryer felt pressure and substantially reduce the edge shrinkage.

This control of shrinkage will produce more uniform cross-direction property profiles, allow the slice opening to remain level, reduce the cross-machine direction variations in fiber orientation and minimize any tendency for curl, cockle or grainy edges to develop. Also, the web can be restrained during transfer between dryers as shown in our U.S. Pat. No. 4,934,067.

We claim:

1. A papermaking machine comprising:

a forming section for forming a paper web;

a press section for pressing water from the paper web; and a dryer for drying the paper web, said dryer comprising a wet end adapted for drying the paper web to at least about 60 percent solids and a dry end for further drying the paper web, said dry end including:

at least one series of alternating dryer cylinders and vacuum rolls;

a dryer felt having a first side wrapped about each dryer cylinder and a second side wrapped about each vacuum roll in said series, the first side of said dryer felt being adapted for transporting the paper web as said dryer felt travels about each dryer cylinder and each vacuum roll of said series; and vacuum apparatus adapted and operatively connected to provide a vacuum of at least about one inch water column at the flange of at least one vacuum roll of said series.

2. The machine of claim 1, in which said series and said dryer felt define one entire dryer group.

3. The machine of claim 1, in which said vacuum apparatus is connected to at least two of the vacuum rolls of said series.

4. The machine of claim 1, in which said vacuum apparatus is connected to a majority of the vacuum rolls of said series.

5. The machine of claim 1, in which said vacuum apparatus is connected to all of the vacuum rolls of said series.

6. The machine of claim 1, in which said vacuum apparatus is one source of vacuum connected to all of the vacuum rolls of said series.

7. The machine of claim 1, comprising a felt tensioner for applying tension to said dryer felt as it wraps about at least one of the dryer cylinders of said series.

8. The machine of claim 1, in which the dryer cylinders of said series are arranged in a single row.

9. The machine of claim 1, in which said single row is substantially horizontal.

10. The machine of claim 1, in which said dry end further comprises a second series of alternating dryer cylinders and vacuum rolls; a second dryer felt having a first side wrapped about each dryer cylinder and a second side wrapped about each vacuum roll in said second series, the first side of said second dryer felt being adapted for transporting the paper web as said second dryer felt travels about each dryer cylinder and each vacuum roll of said second series; and vacuum apparatus connected to at least one of the vacuum rolls of said second series.

11. The machine of claim 1, in which said wet end comprises at least one series of alternating dryer cylinders and vacuum rolls and a dryer felt having a first side wrapped about each dryer cylinder and a second side wrapped about each vacuum roll in said wet end series, the first side of said wet end felt being adapted for transporting the paper web as said wet end felt travels about each dryer cylinder and each vacuum roll of said wet end series.

12. The machine of claim 11, in which said wet end further comprises a second series of alternating dryer cylinders and vacuum rolls; a second dryer felt having a first side wrapped about each dryer cylinder and a second side wrapped about each vacuum roll in said second series, the first side of said second dryer felt being adapted for transporting the paper web as said second dryer felt travels about each dryer cylinder and each vacuum roll of said second series; and vacuum apparatus connected to at least one of the vacuum rolls of said second series.

13. The papermaking machine of claim 1, wherein said vacuum is at least about two inches water column.

14. The papermaking machine of claim 1, wherein said vacuum is at least about six inches water column.

15. A papermaking machine for forming a paper web, comprising:

a forming section for forming a wet paper web;

a press section for pressing the wet paper web; and a dryer for drying the wet paper web, said dryer comprising a wet end adapted for drying the paper web to at least about 60 percent solids and a dry end for further drying the paper web, said dry end including:

at least one complete dryer group of alternating dryer cylinders and vacuum rolls, of which the dryer cylinders are arranged in a single row;

said group including a dryer felt having a first side wrapped about each dryer cylinder and a second side wrapped about each vacuum roll in said dryer group;

the first side of said dryer felt being adapted for transporting the paper web as said dryer felt travels about each dryer cylinder and each vacuum roll of said dryer group; and vacuum apparatus connected to at least one vacuum roll of said dryer group and adapted to draw the paper web against said felt.

16. A papermaking machine for forming a paper web, comprising:

a forming section for forming a wet paper web;

a press section for pressing the wet paper web; and a dryer for drying the wet paper web, said dryer comprising a wet end adapted for drying the paper web to at least about 60 percent solids and a dry end for further drying the paper web, said dry end including:

at least one complete dryer group of alternating dryer cylinders and return rolls, wherein one return roll is positioned between each adjacent pair of dryer cylinders and said one return roll is a vacuum roll;

said group including a dryer felt having a first side wrapped about each dryer cylinder and a second side wrapped about each return roll in said dryer group;

the first side of said dryer felt being adapted for transporting the paper web as said dryer felt travels about each dryer cylinder and each vacuum roll of said dryer group; and vacuum apparatus connected to at least one vacuum roll of said dryer group and adapted to draw the paper web against said felt.

17. A papermaking machine comprising a forming section for forming a web and a dryer for drying the web, the dryer comprising:

a wet end including multiple dryer cylinders adapted for drying a web to a threshold dryness level of at least about 60% solids; and a dry end located downstream of said wet end and including an alternating series of at least one dryer cylinder and at least one vacuum roll wrapped by at least one dryer felt, the dryer felt including at least one curved first run wrapped around a vacuum roll for restraining the web with vacuum, at least one straight second run extending between a vacuum roll and a dryer cylinder, and at least one curved third run wrapped around a dryer cylinder for restraining the web between the felt and the dryer cylinder;

in which at least one of said vacuum rolls is supplied with vacuum at a vacuum level of at least about one inch water column to restrain the web along said curved first runs.

18. A method for manufacturing a paper web, comprising the steps of:

forming a wet paper web;

providing a dryer having a wet end and a dry end, said dry end comprising at least one series of alternating dryer cylinders and vacuum rolls and a dryer felt having a first side wrapped about each dryer cylinder and a second side wrapped about each vacuum roll in said series;

pre-drying the paper web in said wet end to at least about 60 percent solids;

conveying the paper web and said dryer felt together along substantially the same path about each dryer cylinder and each vacuum roll of said series; and applying a vacuum of at least about one inch water column to at least one of the vacuum rolls of said series.

19. The method of claim 18, wherein said vacuum is at least about two inches water column.

20. The method of claim 18, wherein said vacuum is at least about six inches water column.

21. The method of claim 18, in which the vacuum of at least about one inch water column is provided to at least two vacuum rolls of said series.

22. The method of claim 18, in which the vacuum of at least about one inch water column is provided to at least a majority of the vacuum rolls of said series.

23. The method of claim 18, in which the vacuum of at least about one inch water column is provided to each vacuum roll of said series.

24. The method of claim 18, comprising the further step of applying tension to said dryer felt as it wraps about at least one of the dryer cylinders of said series.

25. The method of claim 18, comprising the further step of depositing the paper web on said first side of said dryer felt.

26. The method of claim 18, wherein said step of partially drying the web in a wet end of the dryer is continued at least until a threshold dryness level is reached at which the rate of cross-machine direction shrinkage of an identically-formed web would increase substantially if it were dried without restraint.

27. The method of claim 18, in which the level of said vacuum is sufficient to reduce the overall cross-machine direction shrinkage of the web to at most about 4%.

28. The method of claim 18, in which the level of said vacuum is sufficient to reduce the overall cross-machine direction shrinkage of the web to at most about 3%.

29. The method of claim 18, in which the level of said vacuum is sufficient to reduce the cross-machine direction shrinkage of the entire web substantially to the unrestrained cross-machine direction shrinkage of the center of the web.

30. The method of claim 18, in which the level of said vacuum is sufficient to reduce the overall cross-machine direction shrinkage of the web by at least about half, compared to the overall cross-machine direction shrinkage of an identically formed web which is dried without restraint.

31. The method of claim 18, in which the level of said vacuum is sufficient to reduce the overall cross-machine direction stretch of the web to at most about 3.6%.

32. The method of claim 18, in which the level of said vacuum is sufficient to reduce the overall cross-machine direction stretch of the web to at most about 3%.

33. The method of claim 18, in which the level of said vacuum is sufficient to reduce the percent cross-machine direction stretch of the entire web substantially to the percent cross-machine direction stretch of the center of the web.

34. The method of claim 18, in which the level of said vacuum is sufficient to reduce the overall cross-machine direction stretch of the web by at least about 43%, compared to the overall cross-machine direction stretch of an identically formed web which is dried without restraint.

35. The method of claim 18, in which the level of said vacuum is sufficient to reduce the overall cross-machine direction stretch of the web by at least about 46%, compared to the overall cross-machine direction stretch of an identically formed web which is dried without restraint.

36. The method of claim 18, in which the level of said vacuum is sufficient to reduce the cross-machine direction tensile energy absorption of the web to at most about 0.4 kJ/Kg.

37. The method of claim 18, in which the level of said vacuum is sufficient to reduce the hygroexpansivity of the web to at most about 0.006 percent per percent relative humidity.

38. The method of claim 18, in which the level of said vacuum is sufficient to reduce the hygroexpansivity of the web by at least about 40%, compared to the hygroexpansivity of an identically formed web which is dried without restraint.

39. The method of claim 18, in which said dry end further comprises a second series of alternating dryer cylinders and vacuum rolls and a second dryer felt having a first side wrapped about each dryer cylinder and a second side wrapped about each vacuum roll in said second series.

40. The method of claim 39, comprising the further step of supplying a vacuum of at least about one inch water column to at least one vacuum roll of said second series.

41. The method of claim 18, in which said step of drying the paper web in said wet end is carried out by:

A. providing in said wet end at least one series of alternating dryer cylinders and vacuum rolls and a dryer felt having a first side wrapped about each dryer cylinder and a second side wrapped about each vacuum roll in said wet end series; and D. conveying the paper web and said wet end dryer felt together along substantially the same path about each dryer cylinder and each vacuum roll of said wet end series.

42. The method of claim 41, in which said wet end further comprises a second series of alternating dryer cylinders and vacuum rolls and a second dryer felt having a first side wrapped about each dryer cylinder and a second side wrapped about each vacuum roll in said second series.

43. The method of claim 42, comprising the further step of supplying a vacuum of at least about one inch water column to at least one vacuum roll of said second series.

44. A process for the restrained drying of a paper web in the dryer of a papermaking machine, comprising the steps of:

drying the paper web in said papermaking machine to at least about 60 percent solids;

after said drying step, moving the paper web and a dryer felt contiguously to each other such that the web and felt wrap a portion of a heated surface of a rotatable dryer such that the web is disposed between the felt and the heated surface so that the web is restrained against cross-machine directional shrinkage;

thereafter guiding the web and felt contiguously relative to each other around a vacuum roll disposed downstream relative to the dryer, the arrangement being such that the web is supported by the felt during passage of the web along the felt draw between the dryer and the guide roll, such that the felt is disposed between the web and the guide roll when the web and felt wrap around a portion of the surface of the guide roll;

connecting the guide roll to a source of vacuum of at least one inch water column such that a vacuum is applied to the web through the felt when the web and felt wrap around the guide roll so that the web is drawn into close conformity with the felt when the web and felt wrap around the guide roll, the arrangement being such that the web is restrained against cross-machine directional shrinkage during movement of the web around the guide roll; and leading the web and felt contiguously around a further dryer disposed downstream relative to the guide roll, so that cross-machine directional shrinkage of the web after said drying step is at least reduced.

45. A process for reducing the cross-machine direction shrinkage of a paper web, comprising the steps of:

providing a papermaking machine having at least a forming section for forming a web and a dryer for drying the web, the dryer having a wet end and a dry end;

the dry end of the dryer including a complete dryer group which is an alternating series of at least two dryer cylinders and at least one vacuum roll wrapped by at least one dryer felt, of which the dryer cylinders are arranged in a single row;

the dryer felt including at least one curved first run wrapped around a vacuum roll for restraining the web with vacuum, at least one straight second run extending between a vacuum roll and a dryer cylinder, and at least one curved third run wrapped around a dryer cylinder for restraining the web between the felt and the dryer cylinder;

forming a web from a furnish in the forming section;

partially drying the web in the wet end of the dryer to a threshold dryness level of at least about 60% solids;

further drying the web under restraint in the dry end of the dryer by supporting the web on the felt and conveying the felt through the first, second, and third runs, thus wrapping the web about a vacuum roll outside the felt in one run and wrapping the web about a dryer cylinder inside the felt in a third run.

46. The process of claim 45 comprising the further step, while carrying out the further drying step, of operating the vacuum rolls at vacuum levels of at least about one inch water column.

47. The process of claim 46, wherein said vacuum is at least about two inches water column.

48. The method of claim 47, wherein said vacuum is at least about four inches water column.

49. The method of claim 47, wherein said vacuum is at least about six inches water column.

* * * * *